US007674363B2

(12) United States Patent
Adams et al.

(10) Patent No.: US 7,674,363 B2
(45) Date of Patent: Mar. 9, 2010

(54) PROCESS TO PREPARE A HAZE FREE BASE OIL

(75) Inventors: Nicholas James Adams, Rosehill (AU); Gilbert Robert Bernard Germaine, Petit Couronne (FR)

(73) Assignee: Shell Oil Company, Houston, TX (US)

( * ) Notice: Subject to any disclaimer, the term of this patent is extended or adjusted under 35 U.S.C. 154(b) by 415 days.

(21) Appl. No.: 10/583,790

(22) PCT Filed: Dec. 21, 2004

(86) PCT No.: PCT/EP2004/053635

§ 371 (c)(1),
(2), (4) Date: Jun. 21, 2006

(87) PCT Pub. No.: WO2005/063940

PCT Pub. Date: Jul. 14, 2005

(65) Prior Publication Data

US 2007/0158237 A1 Jul. 12, 2007

(30) Foreign Application Priority Data

Dec. 23, 2003 (EP) ..... 03293321

(51) Int. Cl.
*C10G 69/00* (2006.01)

(52) U.S. Cl. ..... 208/18; 208/49; 208/58; 208/60; 208/62; 208/63; 208/64; 208/65

(58) Field of Classification Search ..... 208/18–20, 208/24, 27–33, 142–145, 49, 58, 60, 62–65
See application file for complete search history.

(56) References Cited

U.S. PATENT DOCUMENTS

| | | | | |
|---|---|---|---|---|
| 3,005,768 | A | 10/1961 | Burke | 208/28 |
| 3,673,078 | A | 6/1972 | Kirk, Jr. | 208/89 |
| 4,343,692 | A | 8/1982 | Winquist | 208/111 |
| 4,574,043 | A | 3/1986 | Chester et al. | 208/59 |
| 4,859,311 | A | 8/1989 | Miller | 208/89 |
| 4,943,672 | A | 7/1990 | Hamner et al. | 585/737 |
| 4,975,177 | A | 12/1990 | Garwood et al. | 208/27 |
| 5,053,373 | A | 10/1991 | Zones | 502/64 |
| 5,059,299 | A | 10/1991 | Cody et al. | 208/27 |
| 5,157,191 | A | 10/1992 | Bowes et al. | 585/533 |
| 5,252,527 | A | 10/1993 | Zones | 502/64 |
| 5,866,751 | A | 2/1999 | Womack, Jr. et al. | 585/899 |
| 6,699,385 | B2 * | 3/2004 | Miller | 208/27 |
| 7,285,206 | B2 * | 10/2007 | Germaine | 208/108 |
| 2004/0065581 | A1 | 4/2004 | Jiang et al. | 208/18 |
| 2004/0154957 | A1 | 8/2004 | Keeney et al. | 208/18 |
| 2004/0181110 | A1 | 9/2004 | Miller et al. | 585/739 |

FOREIGN PATENT DOCUMENTS

| | | |
|---|---|---|
| AU | 698392 | 10/1998 |
| EP | 0471524 | 2/1992 |
| EP | 0515256 | 11/1992 |
| EP | 0532118 | 3/1993 |
| EP | 666894 | 8/1995 |
| EP | 668342 | 8/1995 |
| EP | 0776959 | 6/1997 |
| EP | 0832171 | 4/1998 |
| EP | 1029029 | 4/1999 |
| EP | 1029029 | 8/2000 |
| WO | 96/13563 | 5/1996 |
| WO | 97/18278 | 5/1997 |
| WO | 97/21788 | 6/1997 |
| WO | 99/20720 | 4/1999 |
| WO | 99/34917 | 7/1999 |
| WO | 99/41332 | 8/1999 |
| WO | 99/41335 | 8/1999 |
| WO | 00/08115 | 2/2000 |
| WO | 00/14179 | 3/2000 |
| WO | 00/14183 | 3/2000 |
| WO | 00/14187 | 3/2000 |
| WO | 00/14188 | 3/2000 |
| WO | 00/15736 | 3/2000 |
| WO | 00/29511 | 5/2000 |
| WO | WO99/20720 | 8/2000 |
| WO | 01/18156 | 3/2001 |
| WO | 01/57166 | 8/2001 |
| WO | 02/070627 | 9/2002 |
| WO | WO 02/070628 A2 * | 9/2002 |
| WO | 02/099014 | 12/2002 |

(Continued)

OTHER PUBLICATIONS

Sequeira, A. (1994). Lubricant Base Oil and Wax Processing. New York: Marcel Dekker, 288 pages.*

(Continued)

*Primary Examiner*—Robert J Hill, Jr.
*Assistant Examiner*—Brian McCaig

(57) ABSTRACT

Process to prepare a haze free base oil having a cloud point of below 0° C. and a kinematic viscosity at 100° C. of greater than 10 cSt by performing the following steps: (a) hydroisomerisation of a Fischer-Tropsch synthesis product, (b) isolating one or more fuel products and a distillation residue, (c) reducing the wax content of the residue by contacting the feed with a hydroisomerization catalyst under hydroisomerization conditions, and (d) solvent dewaxing the product of step (c) to obtain the haze free base oil.

22 Claims, 1 Drawing Sheet

FOREIGN PATENT DOCUMENTS

| | | |
|---|---|---|
| WO | 03/033622 | 4/2003 |
| WO | 2004/033596 | 4/2004 |
| WO | 2004/053027 | 6/2004 |
| WO | WO2005044954 | 5/2005 |

OTHER PUBLICATIONS

Lubricant Base Oil and Wax Processing, Avilino Sequeira, Jr., Marcel Dekker Inc., NY 1994, Chapter 7, pp. 162-165.
International Search Report of PCT/EP2004/053635.

* cited by examiner

PROCESS TO PREPARE A HAZE FREE BASE OIL

The present application claims priority on European Patent Application 03293321.0 filed Dec. 23, 2003.

FIELD OF THE INVENTION

The invention relates to a process to prepare a haze free base oil having a kinematic viscosity at 100° C. of greater than 10 cSt from a Fischer-Tropsch wax.

BACKGROUND OF THE INVENTION

WO-A-02070627 describes a process for preparing a base oil having a kinematic viscosity at 100° C. of 22 cSt from a heavy Fischer-Tropsch wax.

A problem of the prior art processes is that especially the base oils having a high viscosity often show a haze. This haze makes the process less suitable for some applications. However not all applications for this family of base oils require that a haze should be absent.

WO-A-03033622 describes a process wherein a haze free base oil is prepared from a Fischer-Tropsch product by removing the heaviest fraction, containing the haze precursors, by deep-cut distillation.

A disadvantage of the process according to WO A-03033622 is the deep cut distillation performed at a cut-off temperature of between 1150 and 1350° F. (621-732° C.). This is not only a technically difficult distillation step it also removes the valuable heavy base oil molecules together with the haze precursors.

SUMMARY OF THE INVENTION

The invention provides a process to prepare a haze free base oil having a cloud point of below 0° C. and a kinematic viscosity at 100° C. of greater than 10 cSt by performing the following steps:

(a) hydroisomerisation of a Fischer-Tropsch synthesis product;

(b) isolating one or more fuel products and a distillation residue;

(c) reducing the wax content of the residue by contacting the feed with a hydroisomerisation catalyst under hydroisomerisation conditions; and (d) solvent dewaxing the product of step (c) to obtain the haze free base oil.

BRIEF DESCRIPTION OF THE DRAWING

The invention will be further illustrated in FIG. 1.

DETAILED DESCRIPTION OF THE INVENTION

Figure 1:
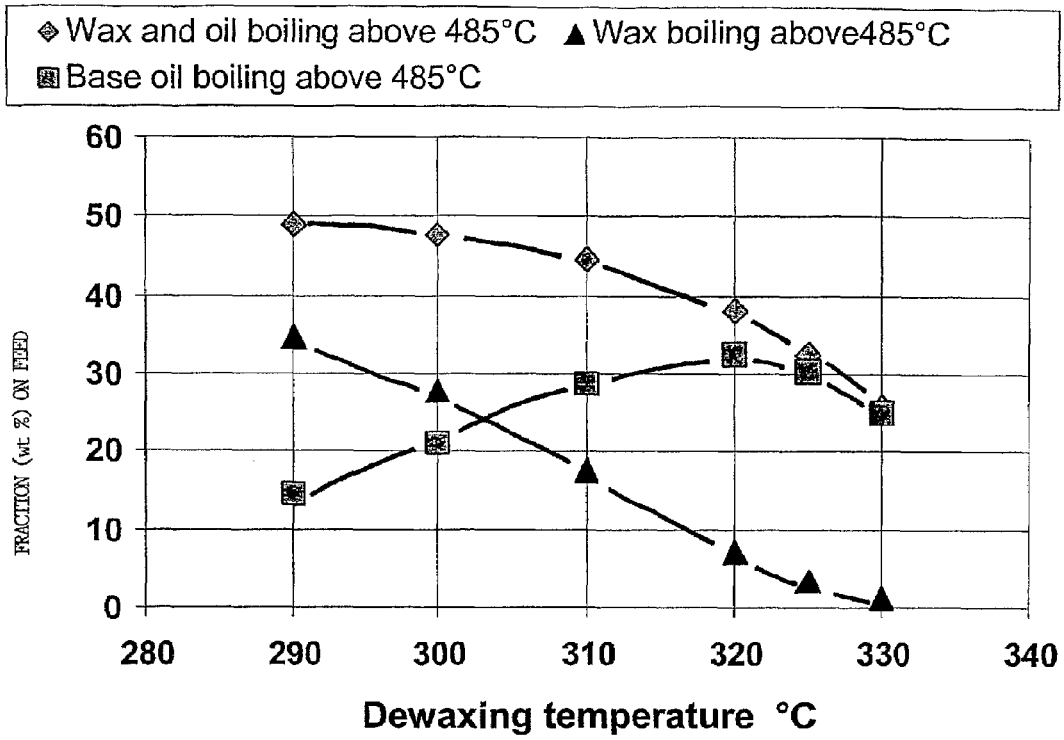
FIG. 1 is a graph illustrating the effect of dewaxing severity on various yields.

The process is advantageous because the wax feed used in step (a) contains the heaviest molecules as prepared in the Fischer-Tropsch synthesis. This is advantageous because it is now possible to prepare high viscosity grade base oils without having to perform a deep-cut distillation in order to remove possible haze-precursors. These advantages are even more pronounced when the feed to step (a), or (c), contains a large fraction of very high boiling compounds.

The Fischer-Tropsch synthesis product as used in step (a) can be obtained by well-known processes, for example the so-called Sasol process, the Shell Middle Distillate Process or by the ExxonMobil "AGC-21" process. These and other processes are for example described in more detail in EP-A-776959, EP-A-668342, U.S. Pat. No. 4,943,672, U.S. Pat. No. 5,059,299, WO-A-9934917 and WO-A-9920720.

More preferably the Fischer-Tropsch synthesis product comprises for at least 30 wt %, preferably at least 50 wt %, and more preferably at least 55 wt % of compounds having at least 30 carbon atoms. Furthermore the weight ratio of compounds having at least 60 or more carbon atoms and compounds having at least 30 carbon atoms of the Fischer-Tropsch product is at least 0.2, preferably at least 0.4 and more preferably at least 0.55.

Preferably the Fischer-Tropsch product comprises a $C_{20}$+ fraction having an ASF-alpha value (Anderson-Schulz-Flory chain growth factor) of at least 0.925, preferably at least 0.935, more preferably at least 0.945, even more preferably at least 0.955.

The initial boiling point of the Fischer-Tropsch product may range up to 400° C., but is preferably below 200° C. Preferably any compounds having 4 or less carbon atoms and any compounds having a boiling point in that range are separated from a Fischer-Tropsch synthesis product before the Fischer-Tropsch synthesis product is used in said hydroisomerisation step.

Such a Fischer-Tropsch product can be obtained by any process, which yields a relatively heavy Fischer-Tropsch product. Not all Fischer-Tropsch processes yield such a heavy product. An example of a suitable Fischer-Tropsch process is described in WO-A-9934917 and in AU-A-698392. These processes may yield a Fischer-Tropsch product as described above.

The Fischer-Tropsch product will contain no or very little sulphur and nitrogen containing compounds. This is typical for a product derived from a Fischer-Tropsch reaction, which uses synthesis gas containing almost no impurities. Sulphur and nitrogen levels will generally be below the detection limits, which are currently 5 ppm for sulphur and 1 ppm for nitrogen.

The hydrocracking/hydroisomerisation reaction in step (a) is preferably performed in the presence of hydrogen and a catalyst, which catalyst can be chosen from those known to one skilled in the art as being suitable for this reaction. Catalysts for use in the hydroisomerisation typically comprise an acidic functionality and a hydrogenation/dehydrogenation functionality. Preferred acidic functionality's are refractory metal oxide carriers. Suitable carrier materials include silica, alumina, silica-alumina, zirconia, titania and mixtures thereof. Preferred carrier materials for inclusion in the catalyst for use in the process of this invention are silica, alumina and silica-alumina. A particularly preferred catalyst comprises platinum supported on a silica-alumina carrier. Preferably the catalyst does not contain a halogen compound, such as for example fluorine, because the use of such catalysts require special operating conditions and involve environmental problems. Examples of suitable hydrocracking/hydroisomerisation processes and suitable catalysts are described in WO-A-0014179, EP-A-532118, EP-A-666894 and the earlier referred to EP-A-776959.

Preferred hydrogenation/dehydrogenation functionality's are Group VIII metals, for example cobalt, nickel, palladium and platinum and more preferably platinum. In case of platinum and palladium the catalyst may comprise the hydrogenation/dehydrogenation active component in an amount of from 0.005 to 5 parts by weight, preferably from 0.02 to 2 parts by weight, per 100 parts by weight of carrier material. In case nickel or cobalt is used a higher content will be present, optionally nickel is used in combination with copper. A particularly preferred catalyst for use in the hydroconversion stage comprises platinum in an amount in the range of from 0.05 to 2 parts by weight, more preferably from 0.1 to 1 parts by weight, per 100 parts by weight of carrier material. The catalyst may also comprise a binder to enhance the strength of the catalyst. The binder can be non-acidic. Examples are clays and other binders known to one skilled in the art.

In the hydroisomerisation the feed is contacted with hydrogen in the presence of the catalyst at elevated temperature and pressure. The temperatures typically will be in the range of from 175 to 380° C., preferably higher than 250° C. and more preferably from 300 to 370° C. The pressure will typically be in the range of from 10 to 250 bar and preferably between 20 and 80 bar. Hydrogen may be supplied at a gas hourly space velocity of from 100 to 10000 Nl/l/hr, preferably from 500 to 5000 Nl/l/hr. The hydrocarbon feed may be provided at a weight hourly space velocity of from 0.1 to 5 kg/l/hr, preferably higher than 0.5 kg/l/hr and more preferably lower than 2 kg/l/hr. The ratio of hydrogen to hydrocarbon feed may range from 100 to 5000 Nl/kg and is preferably from 250 to 2500 Nl/kg.

The conversion in the hydroisomerisation as defined as the weight percentage of the feed boiling above 370° C. which reacts per pass to a fraction boiling below 370° C., is at least 20 wt %, preferably at least 25 wt %, but preferably not more than 80 wt %, more preferably not more than 70 wt %. The feed as used above in the definition is the total hydrocarbon feed fed to the hydroisomerisation, thus also any optional recycle to step (a).

In step (b) one or more distillate separations are performed on the effluent of the hydroisomerisation to obtain at least one middle distillate fuel fraction and the residue, which is to be used in step (c). Preferably the effluent of step (a) is subjected to an atmospheric distillation. The intermediate residue as obtained in such a distillation is subjected to a further distillation performed at near vacuum conditions. This atmospheric bottom product or residue preferably boils for at least 95 wt % above 370° C. The vacuum distillation is suitably performed at a pressure of between 0.001 and 0.1 bara. The residue as isolated in step (b) is obtained as the bottom product of such a vacuum distillation. The 10 wt % recovery boiling point of the residue is preferably between 350 and 550° C.

The wax content of the residue is preferably low to start with. However such low wax contents are only achievable at high conversion in step (a) which will also result in less high boiling and viscuous molecules. Thus suitably the wax will be above 30 and more suitably above 50 wt %. The wax content will also depend on the depth of the distillation cut. Higher 10 wt % recovery boiling points for the residue will typically result in a higher wax content as the wax tends to cumulate in said higher boiling point range. Thus in case the 10 wt % recovery boiling point of the residue is above 500° C. the wax content is suitably above 50 wt %. The wax content as used in the description is measured according to the following procedure. 1 weight part of the to be measured oil fraction is diluted with 4 parts of a (50/50 vol/vol) mixture of methyl ethyl ketone and toluene, which is subsequently cooled to −20° C. in a refrigerator. The mixture is subsequently filtered at −20° C. The wax is thoroughly washed with cold solvent, removed from the filter, dried and weighed. If reference is made to oil content a wt % value is meant which is 100% minus the wax content in wt %.

Step (c) may be performed using any hydroconversion process, which is capable of reducing the wax content of the residue. The wax content in the product of step (c) is preferably below 50 wt %, more preferably below 35 wt % and more preferably between 5 and 35 wt %, and even more preferably between 10 and 35 wt %. A minimal amount of wax is required in order to operate a solvent dewaxing step in an optimal manner. Preferably more than 50 wt % and more preferably more than 70 wt % of the intermediate product boils above the 10 wt % recovery point of the residue used in step (c).

A possible process is the hydroisomerisation process as described above for step (a). It has been found that the wax may be reduced to the desired level using such catalyst. By varying the severity of the process conditions as described above a skilled person will easily determine the required operating conditions to arrive at the desired wax conversion. However a temperature of between 300 and 330° C. and a weight hourly space velocity of between 0.1 and 5, more preferably between 0.1 and 3 kg of oil per liter of catalyst per hour (kg/l/hr) are especially preferred for optimising the oil yield.

A preferred class of catalyst, which may be applied in step (c), is the class of dewaxing catalysts. The process conditions applied when using such catalysts should be such that a minimal wax content remains in the oil. In contrast typical catalytic dewaxing processes aim at reducing the wax content to almost zero. Using a dewaxing catalyst comprising a molecular sieve as described in more detail below will result in that more of the heavy molecules are retained in the dewaxed oil then when using a typical amorphous catalyst described for step (a). Thus a more viscuous base oil can then be obtained.

The dewaxing catalyst that may be applied in step (c) suitably comprises a molecular sieve and optionally in combination with a metal having a hydrogenation function, such as the Group VIII metals. Molecular sieves, and more suitably molecular sieves having a pore diameter of between 0.35 and 0.8 nm have shown a good catalytic ability to reduce the wax content of the wax feed. Suitable zeolites are mordenite, beta, ZSM-5, ZSM-12, ZSM-22, ZSM-23, SSZ-32, ZSM-35 and ZSM-48 or combinations of said zeolites. Another preferred group of molecular sieves are the silica-aluminaphosphate (SAPO) materials of which SAPO-11 is most preferred as for example described in U.S. Pat. No. 4,859,311. ZSM-5 may optionally be used in its HZSM-5 form in the absence of any Group VIII metal. The other molecular sieves are preferably used in combination with an added Group VIII metal. Suitable Group VIII metals are nickel, cobalt, platinum and palladium. Examples of possible combinations are Pt/ZSM-12, Pt/ZSM-35, Ni/ZSM-5, Pt/ZSM-23, Pd/ZSM-23, Pt/ZSM-48 and Pt/SAPO-11 or stacked configurations of Pt/zeolite beta and Pt/ZSM-23, Pt/zeolite beta and Pt/ZSM-48 or Pt/zeolite beta and Pt/ZSM-22. Further details and examples of suitable molecular sieves and dewaxing conditions are for example described in WO-A-9718278, U.S. Pat. Nos. 4,343,692, 5,053,373, 5,252,527, US20040065581A, U.S. Pat. No. 4,574,043 and EP-A-1029029.

A preferred class of molecular sieves are those having a relatively low isomerisation selectivity and a high wax conversion selectivity, like ZSM-5 and ferrierite (ZSM-35). Another suitable class of molecular sieves are those of the ZSM-12 type.

The dewaxing catalyst suitably also comprises a binder. The binder can be a synthetic or naturally occurring (inorganic) substance, for example clay, silica and/or metal oxides. Natural occurring clays are for example of the montmorillonite and kaolin families. The binder is preferably a porous binder material, for example a refractory oxide of which examples are: alumina, silica-alumina, silica-magnesia, silica-zirconia, silica-thoria, silica-beryllia, silica-titania as well as ternary compositions for example silica-alumina-thoria, silica-alumina-zirconia, silica-alumina-magnesia and silica-magnesia-zirconia. More preferably a low acidity refractory oxide binder material, which is essentially free of alumina, is used. Examples of these binder materials are silica, zirconia, titanium dioxide, germanium dioxide, boria and mixtures of two or more of these of which examples are listed above. The most preferred binder is silica.

A preferred class of dewaxing catalysts comprise intermediate zeolite crystallites as described above and a low acidity refractory oxide binder material which is essentially free of alumina as described above, wherein the surface of the aluminosilicate zeolite crystallites has been modified by subjecting the aluminosilicate zeolite crystallites to a surface dealumination treatment. A preferred dealumination treatment is done by contacting extrudates of the binder and the zeolite with an aqueous solution of a fluorosilicate salt as described in for example U.S. Pat. No. 5,157,191 or WO-A-0029511. Examples of suitable dewaxing catalysts as described above are silica bound and dealuminated Pt/ZSM-12, silica bound and dealuminated Pt/ZSM-5, silica bound and dealuminated Pt/ZSM-35 as for example described in WO-A-0029511 and EP-B-832171.

The conditions in step (c) when using a dewaxing catalyst typically involve operating temperatures in the range of from 200 to 500° C., suitably from 250 to 400° C. Preferably the temperature is between 300 and 330° C. The hydrogen pressures in the range of from 10 to 200 bar, preferably from 40 to 70 bar, weight hourly space velocities (WHSV) in the range of from 0.1 to 10 kg of oil per liter of catalyst per hour (kg/l/hr), suitably from 0.1 to 5 kg/l/hr, more suitably from 0.1 to 3 kg/l/hr, and preferably about 1 kg/l/hr and hydrogen to oil ratios in the range of from 100 to 2,000 liters of hydrogen per liter of oil.

In step (d) the haze free oil is obtained by solvent dewaxing the product of step (c). Solvent dewaxing is well known to those skilled in the art and involves admixture of one or more solvents and/or wax precipitating agents with the base oil precursor fraction and cooling the mixture to a temperature in the range of from −10° C. to −40° C., preferably in the range of from −20° C. to −35° C., to separate the wax from the oil. The oil containing the wax is usually filtered through a filter cloth which can be made of textile fibres, such as cotton; porous metal cloth; or cloth made of synthetic materials. Examples of solvents which may be employed in the solvent dewaxing process are $C_3$-$C_6$ ketones (e.g. methyl ethyl ketone, methyl isobutyl ketone and mixtures thereof), $C_6$-$C_{10}$ aromatic hydrocarbons (e.g. toluene), mixtures of ketones and aromatics (e.g. methyl ethyl ketone and toluene), autorefrigerative solvents such as liquefied, normally gaseous $C_2$-$C_4$ hydrocarbons such as propane, propylene, butane, butylene and mixtures thereof. Mixtures of methyl ethyl ketone and toluene or methyl ethyl ketone and methyl isobutyl ketone are generally preferred. Examples of these and other suitable solvent dewaxing processes are described in Lubricant Base Oil and Wax Processing, Avilino Sequeira, Jr, Marcel Dekker Inc., New York, 1994, Chapter 7.

In step (d) also a wax is obtained. It has been found that such a wax is a relatively soft microcrystalline wax, which may be used for various purposes. The soft microcrystalline wax as obtained with the above process has preferably a congealing point as determined by ASTM D 938 of between 85 and 120 and more preferably between 95 and 120° C. and a PEN at 43° C. as determined by IP 376 of more than 0.8 mm and preferably more than 1 mm. The wax is further characterized in that it preferably comprises less than 1 wt % aromatic compounds and less than 10 wt % naphthenic compounds, more preferably less than 5 wt % naphthenic compounds. The mol percentage of branched paraffins in the wax is preferably above 33 and more preferably above 45 and below 80 mol % as determined by C13 NMR. This method determines an average molecular weight for the wax and subsequently determines the mol percentage of molecules having a methyl branch, the mol percentage of molecules having an ethyl branch, the mol percentage of molecules having a C3 branch and the mol percentage having a C4+ branch, under the assumption that each molecule does not have more than one branch. The mol % of branched paraffins is the total of these individual percentages. This method calculated the mol % in the wax of an average molecule having only one branch. In reality paraffin molecules having more than one branch may be present. Thus the content of branched paraffins determined by different method may result in a different value.

The oil content of the wax as determined by ASTM D 721 is typically below 10 wt % and more preferably below 6 wt %. If lower oil contents are desired it may be advantageous to perform an additional de-oiling step. De-oiling processes are well known and are for example described in Lubricant Base Oil and Wax Processing, Avilino Sequeira, Jr, Marcel Dekker Inc., New York, 1994, pages 162-165. After de-oiling the wax preferably has a oil content of between 0.1 and 2 wt %. The lower limit is not critical. Values of above 0.5 wt % may be expected, but lower values can be achieved depending on the method in which the wax is obtained. Most likely the oil content will be between 1 and 2 wt %. The kinematic viscosity at 150° C. of the wax is preferably higher than 8 cSt and more preferably higher than 12 and lower than 18 cSt.

The haze free base oil will preferably have a kinematic viscosity at 100° C. of above 10 cSt, preferably above 14 cSt, which viscosity may range up to 30 cSt and even above. The pour point is preferably below −5 and more preferably below −18° C. and even more preferably below −21° C. The viscosity index is suitably above 120 and preferably above 130. A haze free base oil is determined by its cloud point. A haze free base oil according to this invention has a cloud point as determined by ASTM D2500 of near the pour point and below 0° C., preferably below −10° C. and more preferably below −15° C.

Because of these properties the applicant has found that the base oil may be advantageously be used to prepare a lubricant composition which does not require a viscosity modifier (VM). Applicants further found that such a VISCOSITY MODIFIER-free lubricant may be obtained without having to add a poly-alpha olefin co-base oil as shown in WO-A-0157166. The invention is thus also directed to prepare a VM-free lubricant composition by blending a preferably Fischer-Tropsch derived and low viscosity base oil with the haze free base oil as obtained in step (c) and one or more additives. The low viscosity base oil preferably has a kinematic viscosity at 100° C. of less than 7 cSt. The haze free base oil preferably has a kinematic viscosity at 100° C. of more than 10 cSt, more preferably more than 14, and most preferably more than 18 cSt.

Applicants found that by blending the haze free base oil with the lower viscosity grade base oil it is possible to achieve the properties of a SAE "xW−y" viscosity lubricant formulation without having to add a viscosity modifier. Applicants further found that when a viscosity modifier-free lubricant is used as motor engine lubricant in gasoline direct injection (GDI) engines no build up of residue on the back of the inlet valve tulip occurs, which would happen if a VM is present.

It has further been found that especially SAE "xW−y" viscosity lubricant formulations wherein y minus x is greater or equal than 25 can be prepared without having to add a VM. Based on the teaching of WO-A-0157166 one would have expected that such formulations could only be prepared by having to add a VM.

The low-viscosity Fischer-Tropsch derived base oil having a kinematic viscosity at 100° C. of less than 7 cSt preferably has a pour point of less than −18° C., more preferably less than −27° C. The kinematic viscosity at 100° C. is preferably greater than 3.5 cSt and more preferably between 3.5 and 6 cSt. The viscosity index (VI) is preferably greater than 120, more preferably greater than 130. The VI will typically be less than 160. The Noack volatility (according to CEC L40 T87) is preferably less than 14 wt %. The low viscosity component may any Fischer-Tropsch derived base oil as disclosed in for example EP-A-776959, EP-A-668342, WO-A-9721788, WO-0015736, WO-0014188, WO-0014187, WO-0014183, WO-0014179, WO-0008115, WO-9941332, EP-1029029, WO-0118156 and WO-0157166.

The invention will be illustrated with the following non-limiting examples.

EXAMPLE 1

From a hydroisomerised Fischer-Tropsch wax a distillation residue was isolated having the properties as listed in Table 1. The wax content was 34.1 wt % as determined after solvent dewaxing at a dewaxing temperature of −20° C.

TABLE 1

| Feed to catalytic dewaxing | | |
|---|---|---|
| Congealing Point | ° C. | >+48 |
| Density at 70° C. | | 0.7874 |
| IBP % m distilled | ° C. | 261 |
| 10 | ° C. | 346 |
| 50 | ° C. | 482 |
| 70 | ° C. | 564 |
| 90 | ° C. | 665 |
| FBP | ° C. | >750 |

The above residue was contacted with a dewaxing catalyst consisting of 0.7 wt % platinum, 25 wt % ZSM-12 and a silica binder. The dewaxing conditions were 40 bar hydrogen, WHSV=1 kg/l.h, and a hydrogen gas rate of 500 Nl/kg feed. The experiment was carried out at three different reaction temperatures. See results in Table 2.

TABLE 2

| | 1a | 1b | 1c |
|---|---|---|---|
| Temperature in dewaxing reactor (° C.) | 325 | 310 | 300 |
| Yield of fraction boiling above 485° C. by TBP-GLC (wt % on feed) | 34 | 42 | 48 |
| Wax content of the fraction boiling above 485° C. (wt %) * | 7.1 | 34.8 | 56.3 |

wax content as measured after solvent dewaxing at −20° C.

The fraction boiling above 485° C. as obtained in 1a, 1b and 1c was solvent dewaxed using a mixture of methyl ethyl ketone and toluene (50/50 vol/vol) solvent at a dewaxing temperature of −20° C. The properties and yields of the oils obtained are listed in Table 3.

TABLE 3

| Oil Properties | 1a | 1b | 1c |
|---|---|---|---|
| Base oil yield relative to feed to the catalytic dewaxing step (wt %) | 31 | 27 | 21 |
| Clarity of the base oil | Excellent | Good | Bad |
| density 70/4 of the base oil | 0.8026 | 0.8021 | 0.7997 |
| Pour Pont of the base oil (° C.) | −42 | −15 | −9 |
| Vk@40° C. ($mm^2/s$) | 120.6 | 112.6 | Not measured |
| Vk@100° C. ($mm^2/s$) | 16.32 | 16.1 | 13.47 |
| VI | 145 | 143 | Not measured |

Based on the above experimental data FIG. 1 was made. In FIG. 1 it is shown that by increasing the catalytic dewaxing severity the yield to the 485° C. plus fraction decreases, the wax content decreases and the oil yield after solvent dewaxing goes through a maximum.

EXAMPLE 2

From a hydroisomerised Fischer-Tropsch wax a distillation residue was isolated having the properties as listed in Table 4. The wax content was 41 wt % as determined after solvent dewaxing at a dewaxing temperature of −20° C.

TABLE 4

| Feed to catalytic dewaxing | | |
|---|---|---|
| Congealing Point | ° C. | >+85 |
| IBP % m distilled | ° C. | 440 |
| 10 | ° C. | 500 |
| 50 | ° C. | 595 |
| 70 | ° C. | 655 |
| 90 | ° C. | 740 |
| FBP | ° C. | >740 |

The above residue was contacted with a dewaxing catalyst consisting of 0.7 wt % platinum, 25 wt % ZSM-12 and a silica binder. The dewaxing conditions were 40 bar hydrogen, WHSV=1 kg/l.h, and a hydrogen gas rate of 500 Nl/kg feed. The experiment was carried out at 340° C. From the partly dewaxed oil compounds boiling below 500° C. were removed by distillation. The remaining fraction containing 34 wt % wax was a liquid slurry at room temperature. See also the results in Table 5.

TABLE 5

| Example | 2 |
|---|---|
| Temperature in dewaxing reactor (° C.) | 340 |
| Yield of fraction boiling above 500° C. by TBP-GLC (wt % on feed) | 68 |
| Wax content of the fraction boiling above 500° C. (wt %) * | 34 |

* wax content as measured after solvent dewaxing at −20 ° C.

The liquid slurry fraction boiling above 500° C. was solvent dewaxed using a mixture of methyl ethyl ketone and toluene (50/50 vol/vol) solvent at a dewaxing temperature of −20° C. The properties and yields of the oil as obtained are listed in Table 6.

TABLE 6

| Oil Properties | 2 |
|---|---|
| Base oil yield relative to feed to the catalytic dewaxing step (wt %) | 42 |
| Clarity of the base oil | Clear |
| Density 20/4 of the base oil | 0.8331 |
| Pour Pont of the base oil (° C.) | −39 |
| Vk@40° C. ($mm^2/s$) | 111.6 |
| Vk@100° C. ($mm^2/s$) | 15.47 |
| VI | 146 |

We claim:

1. A process to prepare a haze free base oil having a cloud point below 0° C. and a kinematic viscosity at 100° C. greater than 10 cSt comprising the following steps:

(a) hydroisomerizing a Fischer-Tropsch synthesis product, which has a weight ratio of compounds having at least 60 or more carbon atoms to compounds having at least 30 carbon atoms in the Fischer-Tropsch product of at least 0.2 and wherein at least 30 wt % of the compounds in the Fischer-Tropsch synthesis product have at least 30 carbon atoms;

(b) isolating one or more fuel products and a distillation residue;

(c) reducing the wax content of the residue by contacting the feed with a hydroisomerization catalyst under hydroisomerization conditions; and (d) solvent dewaxing the product of step (c) to obtain a haze free base oil.

2. The process according to claim 1, wherein the distillation residue has a 10 wt % recovery boiling point of above 500° C. and a wax content of greater than 50 wt % and wherein in step (c) the wax content is reduced to a value below 50 wt %.

3. The process according to claim 1, wherein the wax content in step (c) is reduced to below 35 wt %.

4. The process according to claim 3, wherein the wax content in the product of step (c) is between 10 and 35 wt %.

5. The process according to claim 1, wherein at least 50 wt % of compounds in the Fischer-Tropsch product have at least 30 carbon atoms.

6. The process according to claim 1, wherein the weight ratio of compounds having at least 60 or more carbon atoms to compounds having at least 30 carbon atoms in the Fischer-Tropsch product is at least 0.4.

7. The process according to claim 1, wherein the 10 wt % recovery boiling point of the residue as isolated in step (b) is between 350 and 550° C.

8. The process according to claim 1, wherein more than 50 wt % of the product of step (c) boils above the 10 wt % recovery point of the residue used as feed in step (c).

9. The process according to claim 8, wherein more than 70 wt % of the product of step (c) boils above the 10 wt % recovery point of the residue used as feed in step (c).

10. The process according to claim 1, wherein the hydroisomerisation catalyst used in step (c) is a substantially amorphous based catalyst comprising a silica-alumina carrier and a noble or non-noble Group VIII metal.

11. The process according to claim 1, wherein the hydroisomerisation catalyst used in step (c) comprises a molecular sieve and a noble or non-noble Group VIII metal.

12. A process to prepare a lubricant composition not containing a viscosity modifier additive by blending a low viscosity base oil with a haze free base oil having a cloud point below 0° C. and a kinematic viscosity at 100° C. greater than 10 cSt prepared by a process comprising:

(a) hydroisomerizing a Fischer-Tropsch synthesis product, which has a weight ratio of compounds having at least 60 or more carbon atoms to compounds having at least 30 carbon atoms in the Fischer-Tropsch product of at least 0.2 and wherein at least 30 wt % of the compounds in the Fischer-Tropsch synthesis product have at least 30 carbon atoms;

(b) isolating one or more fuel products and a distillation residue;

(c) reducing the wax content of the residue by contacting the feed with a hydroisomerization catalyst under hydroisomerization conditions; and (d) solvent dewaxing the product of step (c) to obtain a haze free base oil.

13. The process-according to claim 12, wherein the distillation residue has a 10 wt % recovery boiling point of above 500° C. and a wax content of greater than 50 wt % and wherein in step (c) the wax content reduced to a value below 50 wt %.

14. The process according to claim 12, wherein the wax content in step (c) is reduced to below 35 wt %.

15. The process according to claim 12, wherein the wax content in the product of step (c) is between 10 and 35 wt %.

16. The process according to claim 12, wherein at least 50 wt % of compounds in the Fischer-Tropsch product have at least 30 carbon atoms.

17. The process according to claim 12, wherein the weight ratio of compounds having at least 60 or more carbon atoms and compounds having at least 30 carbon atoms in the Fischer-Tropsch product is at least 0.4.

18. The process according to claim 12, wherein the 10 wt % recovery boiling point of the residue as isolated in step (b) is between 350 and 550° C.

19. The process according to claim 12, wherein more than 50 wt % of the product of step (c) boils above the 10 wt % recovery point of the residue used as feed in step (c).

20. The process according to claim 12, wherein more than 70 wt % of the product of step (c) boils above the 10 wt % recovery point of the residue used as feed in step (c).

21. The process according to claim 12, wherein the hydroisomerisation catalyst used in step (c) is a substantially amorphous based catalyst comprising a silica-alumina carrier and a noble or non-noble Group VIII metal.

22. The process according to claim 12, wherein the hydroisomerisation catalyst used in step (c) comprises a molecular sieve and a noble or non-noble Group VIII metal.

* * * * *